United States Patent [19]

Rahnenführer et al.

[11] Patent Number: 4,922,823

[45] Date of Patent: May 8, 1990

[54] IGNITION TRANSFER CHARGE FOR A PROPELLING CHARGE

[75] Inventors: Eckhard Rahnenführer, Dormagen; Albert Schulze, Mönchengladbach; Heinz Jaskolka, Velbert, all of Fed. Rep. of Germany

[73] Assignee: Rheinmetall GmbH, Düsseldorf, Fed. Rep. of Germany

[21] Appl. No.: 239,174

[22] Filed: Aug. 31, 1988

[30] Foreign Application Priority Data

Sep. 11, 1987 [DE] Fed. Rep. of Germany ..... 3730530

[51] Int. Cl.[5] ..... C06D 5/06

[52] U.S. Cl. ..... 102/288; 102/289; 102/275.11; 102/317; 102/318

[58] Field of Search ..... 102/288, 289, 275.11, 102/317, 318

[56] References Cited

U.S. PATENT DOCUMENTS

| | | | |
|---|---|---|---|
| 4,005,659 | 2/1977 | Schneider, Jr. et al. | 102/72 |
| 4,609,056 | 9/1986 | Colle, Jr. et al. | 102/531 |
| 4,702,167 | 10/1987 | Reinelt et al. | 102/282 |

*Primary Examiner*—Peter A. Nelson

*Attorney, Agent, or Firm*—Spencer & Frank

[57] ABSTRACT

An ignition transfer body for a propellant-charge module is coaxially surrounded by a supporting tube and includes at least one clear ignition channel. The ignition transfer charge is composed of a first propellant-charge powder generating thermal energy in a range of 3 kJ/g to 4.5 kJ/g, and the supporting tube is composed of a second propellant-charge powder. Preferably, the second propellant-charge powder forming the supporting tube is pressed powder which is extruded or pressed in a mold.

20 Claims, 1 Drawing Sheet

IGNITION TRANSFER CHARGE FOR A PROPELLING CHARGE

BACKGROUND OF THE INVENTION

The present invention relates to an ignition transfer body for a propelling charge, wherein the ignition transfer body has an ignition transfer charge which is coaxially surrounded by a supporting tube and includes at least one clear detonation passage or ignition channel.

Such an ignition transfer body, which is preferably used for propellant-charge modules, is disclosed in German Pat. No. 3,432,291, corresponding to U.S. Pat. No. 4, 702,167. This type of an ignition transfer body may be produced, in one embodiment, from stacked individual rings which are disposed concentrically about a combustible tube having a central axis. These rings may be composed for example of boron potassium nitrate powder or, in another embodiment, of porous nitrocellulose which may be extruded in tubular form. The ignition transfer body composed of the above-mentioned or comparable substances is formed into a member which is symmetrical axially and radially of the central axis of the propellant-charge module, thus enabling the propellant-charge module to be ignited axially from either end face so that it is well suited for automatic loading processes. However, under extreme stresses as might occur for example during sudden acceleration processes, shock sensitive ignition transfer bodies for example may become unstable and suffer brittle failure due to their comparatively low mechanical strength.

SUMMARY OF THE INVENTION

It is an object of the invention to provide an ignition transfer body which is able to withstand extreme stresses and which additionally ensures good ignition conditions throughout a propellant-charge module, the ignition transfer body having an ignition transfer charge surrounded by a supporting tube which is composed of a propellant-charge powder to increase the energy balance of the propelling charge.

The above and other objects are accomplished according to the present invention by the provision of an ignition transfer body for a propellant-charge module, wherein the ignition transfer body has:

(a) an ignition transfer charge having a longitudinal axis composed of a high energy first propellant-charge powder generating thermal energy in a range from 3 kJ/g to 4.5 kJ/g, having at least one clear ignition channel having a longitudinal axis oriented in a direction generally parallel to the longitudinal axis of the ignition transfer charge; and (b) a supporting tube composed of a second propellant charge powder coaxially encasing the ignition transfer charge.

A propellant-charge powder can be used according to the invention by pressing it in a mold to form a tubular ignition transfer charge, while another type of propellant-charge powder is pressed to form the supporting tube to support the ignition transfer body. This configuration is particularly useful for igniting propellant-charge modules which are to be supplied automatically to the chamber of a large-caliber gun. The ignition transfer charge, when attached to the surrounding supporting tube, results in a structure usable as a comparatively high energy ignition transfer body which is capable of generating thermal energy in a range from 3 kJ/g to 4.5 kJ/g, to ignite a propelling charge in a propellant-charge module. The supporting tube is composed of an extruded propellant-charge powder to increase the chemical potential energy which can be released during ignition of the ignition transfer charge. This high energy ignition transfer charge is preferably composed of nitrocellulose containing 20% to 50% nitroglycerin by weight. The invention thereby results in an easily manufactured ignition transfer body having relatively precise dimensions which is stable during sudden acceleration processes. The supporting tube is composed of a conventional propellant-charge powder which, in its compressed form, has a relatively high elasticity, thereby giving it strength against sudden acceleration loading.

The material forming the brittle ignition transfer charge is not used for the supporting tube, however, since this could lead to brittle failure caused by sudden stresses which may occur during handling or loading. Examples of such unacceptable materials include, for example, compressed ignition charge granules such as NSP (nitrocellulose black powder) which are subject to breakage under sudden mechanical stresses. Instead, the supporting tube according to the present invention advantageously includes a single or multibase propellant-charge powder without solvent which, in compressed form, is able to withstand such sudden stresses. A particularly uniform ignition is ensured if the material which composes the supporting tube is the same as the propellant-charge powder (surrounding the supporting tube) which is to be ignited.

By using an ignition transfer charge composed of a high energy propellant-charge powder, it is possible to produce such a body in the form of extruded tubes or cylinders having a relatively high dimensional precision. Such tubes or cylinders can be attached to the interior wall of the supporting tube by means of an adhesive to form the ignition transfer body.

Moreover, use of an extrusion process permits the ignition transfer charge and the supporting tube to be manufactured as a multi-layer tube (for example, by coextrusion) wherein each layer can be composed of a different propellant-charge powder. For example, a high energy first propellant-charge powder can be used to form the ignition transfer charge which is encased by a supporting tube composed of a second propellant-charge powder carrier layer. This extruded, multi-layer tube preferably includes at least one clear ignition channel. The process of pressing or coextruding such a multi-layer tube permits the simultaneous formation of surface-area-enlarging longitudinal grooves along the clear ignition channel in a single process step (e.g., by provision of a suitable extrusion die head during the coextrusion process) in order to increase ignition sensitivity and thereby produce better propagation of the ignition. It is possible to later roll-in transverse grooves in the clear ignition channel in a relatively simple manner. The present invention thereby eliminates the need for use of a special ignition means.

The use of a comparatively shock-insensitive carrier member such as the supporting tube discussed in the foregoing permits the use of several different manufacturing methods for the attachment of the ignition transfer charge to the carrier member (as compared to the case where the carrier member is relatively shock-sensitive). For example, the ignition transfer charge can be provided as a comparatively thin-walled tubular sheet which can be glued to an interior wall of a supporting tube which serves as the carrier member. Such a thin-walled tubular sheet can also be formed on the interior wall of the supporting tube by spraying a coating thereon which is composed of the material used to form the ignition transfer charge.

In each of the foregoing processes, the combined wall thickness of the layer composed of the ignition transfer charge and the layer forming the supporting tube can be advantageously varied during manufacturing. Dependent upon the desired diameter and length of the clear ignition channel, the combined wall thickness of the ignition transfer charge and the carrier member can be made to vary between 1 mm and 10 mm, and preferably between 1 mm and 7 mm, to ensure a relatively high reliability and stability when the ignition transfer body is used in a propellant-charge module of a type which can be subjected to automatic loading into the chamber of, for example, a large-caliber gun.

The invention will be described in greater detail below with reference to embodiments which are illustrated in the drawings.

DETAILED DESCRIPTION OF THE PREFERRED EMBODIMENTS

Figure 1:
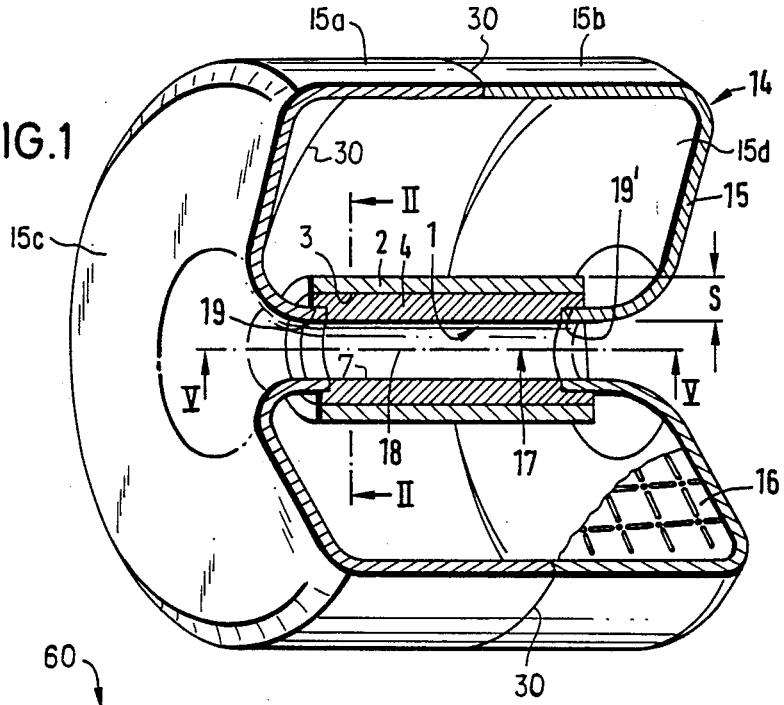
FIG. 1 is a perspective view, partially broken away and in section, of a first embodiment of a propellant-charge module employing an ignition transfer body having an ignition transfer charge surrounded by a supporting tube according to the invention.

As seen in FIG. 1 a propellant-charge module 14 according to the invention has an outer wall or envelope 15 which encloses a black-powder-type propellant-charge powder 16 which surrounds an ignition transfer body 1 and substantially fills the propellant-charge module 14. The propellant-charge module 14 can be employed in tubular weapons (not shown), and preferably in guns. The envelope 15 is axiosymmetric about its longitudinal axis 18 and is planosymmetric about a plane (not shown) extending perpendicularly through the axis 18 at a center of the propellant-charge module, in a manner which is similar to the propellant-charge module disclosed in U.S. Pat. No. 4,702,167.

The envelope 15 is composed of halves 15*a* and 15*b*, as is standard, and is of tubular or polygonal section. The propellant-charge module halves 15*a* and 15*b* are joined along a seam 30. The envelope 15 has two end walls 15*c* and 15*d* which are generally planar and are perpendicular to the axis 18. A detonation passage or clear ignition channel 17 is disposed along the axis 18 and is delimited by an inner wall 7 of an ignition transfer charge 4 to propagate the ignition flame. The propellant-charge powder 16 is shown in only a small portion of the propellant-charge module 14, the remainder being omitted to reveal the internal structure of the propellant-charge module 14.

The ignition transfer charge 4 is composed of a high energy propellant-charge powder which can generate thermal energy in a range of 3 kJ/g to 4.5 kJ/g. Preferably, the ignition transfer charge 4 is composed of a high energy propellant-charge powder which is a mixture of nitrocellulose containing 20% to 50% by weight of nitroglycerin. The ignition transfer charge 4 may be formed and attached in different ways (discussed further hereunder) within a supporting tube 2, which encases and supports the ignition transfer charge 4.

The supporting tube 2 is composed of a conventional single-base or multi-base propellant-charge powder (which can be the same material as that of the propellant-charge powder 16) without solvent. The hollow cylindrical shape of the supporting tube 2 is preferably produced by a pressing process, and preferably by an extrusion process.

Figure 3:
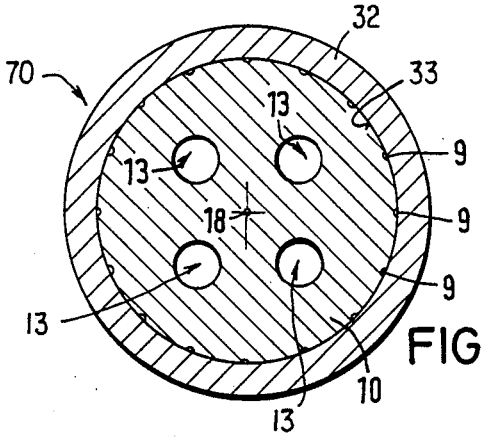
FIG. 3 is a sectional view of a third embodiment of the ignition transfer charge and supporting tube similar to that of FIG. 2, wherein the ignition transfer charge has a plurality of free ignition channels.
Figure 5:
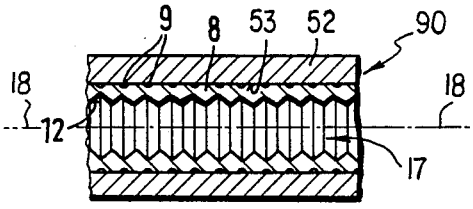
FIG. 5 is a longitudinal sectional view of a fifth embodiment of the ignition transfer charge and the supporting tube as would appear if taken along a line corresponding to the line V—V in the embodiment of FIG. 1, wherein the ignition transfer charge has transverse grooves formed therein.

In FIG. 1, the ignition transfer charge 4 is formed and configured similarly to the supporting tube 2 as a preshaped tube and is connected to an interior wall 3 of the supporting tube 2 by means of an adhesive (not shown). Any type of adhesive can be used which is capable of bonding the ignition transfer charge 4 to the inner wall 3 of the supporting tube 2, and can vary depending upon the materials used. The adhesive may be disposed in a manner similar to that shown for an adhesive 9 which is depicted in FIG. 3. The adhesive 9 is preferably applied uniformly in dots or lines in a circumferential direction (as seen in FIG. 3) and also in a longitudinal direction (as seen in FIG. 5) about the tube-shaped ignition transfer charge 4.

Figure 2:
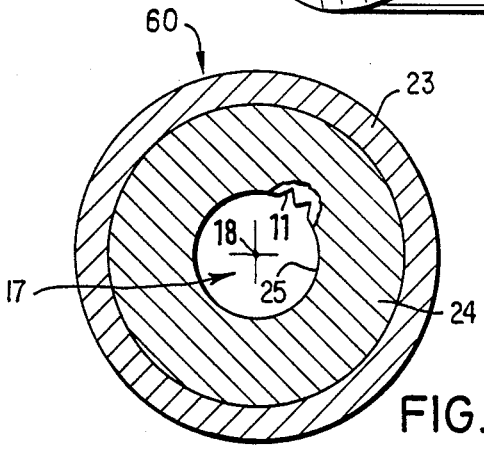
FIG. 2 is a cross-sectional view of a second embodiment of the ignition transfer charge and its supporting tube as would be seen if taken along line II—II of FIG. 1.

The ignition transfer charge 4 is fastened at both ends thereof to the envelope 15 by an internal centering arrangement 19, 19' which respectively engage corresponding shoulders (unnumbered) in both ends of the ignition transfer charge 4. The ignition transfer charge 4 may additionally have formed on its interior surface a plurality of longitudinal grooves (not shown in FIG. 1) which would be similar to grooves 11 as shown in FIG. 2, so as to enlarge the surface area of the inner wall 7 and which could have a roughened depth in a range of 0.5 mm to 3 mm. The longitudinal grooves in this variation may be formed simultaneously with the ignition transfer charge 4 during the extrusion process which forms it. Furthermore, transverse grooves disposed generally concentrically about the axis 18 may be rolled into the inner wall 7 of the ignition transfer charge 4 if desired, as suggested by the transverse grooves depicted in the embodiment of FIG. 5.

In a second embodiment of the invention, shown in FIG. 2, an ignition transfer body 60 includes a clear ignition channel 17 delimited by an ignition transfer charge 24 shaped in the form of a tube and composed of a high-energy first propellant-charge powder such as that discussed hereinabove with respect to the ignition transfer charge 4. A tube-like layer 23 surrounds the ignition transfer charge 24 and is composed of a second propellant-charge powder such as that discussed hereinabove with respect to the supporting tube 2. The ignition transfer body 60 is preferably formed by coextrusion of the ignition transfer charge 24 and the layer 23, the layer 23 corresponding to, and having the same function as, the supporting tube 2 of the first embodiment of the invention. Longitudinal grooves 11 are formed on an interior wall 25 of the ignition transfer charge 24 to increase the surface area thereof. The longitudinal grooves 11 can be formed simultaneously with the tube 24 by provision of a suitable die head in the extrusion process which forms the ignition transfer body 60.

FIG. 3 shows, as a third embodiment, a cylindrical ignition transfer body 70 having an ignition transfer charge 10 in the form of a cylindrical body which is connected with an interior wall 33 of a supporting tube 32. The ignition transfer charge 10 is connected to the interior wall 33 as shown in FIG. 3 by means of the adhesive 9 in a manner as discussed hereinabove. The ignition transfer charge 10 includes at least two, and preferably four, identical and symmetrically arranged clear ignition channels 13 which are empty cylindrical passages which extend in a direction parallel to the longitudinal axis 18. It is contemplated that any number of such channels 13 can be provided in the ignition transfer charge 10 and can be disposed in any desired symmetrical pattern.

Figure 4:
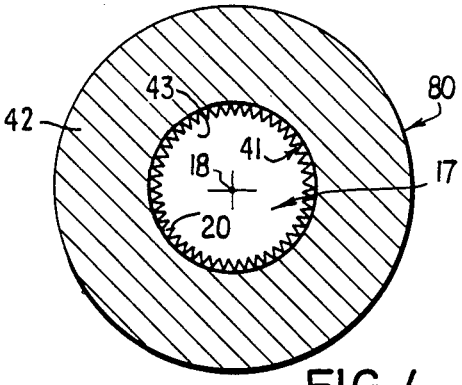
FIG. 4 is a sectional view of a fourth embodiment of the ignition transfer charge and supporting tube similar to that of FIG. 2, wherein the ignition transfer charge is formed as a coating which is sprayed onto the interior wall of the supporting tube.

FIG. 4 illustrates a fourth embodiment of the invention wherein an ignition transfer body 80 has a clear ignition channel 17 delimited by an ignition transfer charge 41 which is formed by a coating 20 composed of material such as that discussed hereinabove with respect to the ignition transfer charge 4 of the first embodiment. The coating 20 is preferably sprayed on an inner wall 43 of a supporting tube 42 to form a shallow tubular coating (shown schematically in FIG. 4). The supporting tube 42 in this embodiment is substantially thicker than the corresponding tube 23 of FIG. 2, and in the preferred embodiment the supporting tube 42 is formed by an extrusion process. The surface roughness caused by the spraying process may obviate the need for additional measures (such as provision of longitudinal grooves) to enlarge the ignition surface area of the coating 20.

FIG. 5 illustrates a fifth embodiment of the invention wherein an ignition transfer body 90 has a clear ignition channel 17 delimited by an ignition transfer charge 8 which is preferably configured as a thin layer or sheet which is formed into a tube-shaped body and secured to an inner wall 53 of a supporting tube 52. The ignition transfer charge 8 is preferably composed of the same material as that of the ignition transfer charge 4 of the first embodiment, and the supporting tube 53 is composed of the same material as that of the supporting tube 2 in the first embodiment. The sheet 8 has a plurality of transverse grooves 12 formed therein which are generally concentrically arranged about the axis 18. The ignition transfer charge 8 is preferably attached to the supporting tube 52 by adhesive 9 as discussed hereinabove. The supporting tube 52 is preferably formed by an extrusion process in a manner similar to that described for the supporting tubes 2, 23, 32, and 42 in the previous embodiments.

It is possible to produce an ignition transfer body in the aforementioned embodiments of FIGS. 1, 2, 4, and 5 wherein the corresponding ignition transfer charge and supporting tube have a combined, shape-retaining wall thickness S in a range of 1 mm to 10 mm, and preferably in a range between 1 mm and 7 mm. The desired wall thickness S can be determined as a function of the required strength of the corresponding ignition transfer body and of the required diameter and length of the corresponding ignition channel. In the embodiment of FIG. 3, a different measure of total wall thickness may be employed, depending upon the size, location, and number of clear ignition channels 13.

The present disclosure relates to the subject matter disclosed in German Application No. P 37 30 530.1 of Sept. 11th, 1987, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. An ignition transfer body for a propellant-charge module, comprising:

(a) an ignition transfer charge having a longitudinal axis composed of a high energy first propellant-charge powder generating thermal energy in a range from 3 kJ/g to 4.5 kJ/g, having at least one clear ignition channel having a longitudinal axis oriented in a direction generally parallel to said longitudinal axis of said ignition transfer charge; and (b) a supporting tube composed of a second propellant-charge powder coaxially encasing said ignition transfer charge.

2. An ignition transfer body as defined in claim 1, wherein said second propellant-charge powder is in the form of pressed powder.

3. An ignition transfer body as defined in claim 1, wherein said ignition transfer charge comprises a preshaped tube which is connected with an inner wall of said supporting tube.

4. An ignition transfer body as defined in claim 1, wherein said high energy first propellant-charge powder is composed of a mixture of nitrocellulose containing 20% to 50% nitroglycerin.

5. An ignition transfer body as defined in claim 1, wherein said ignition transfer charge has a solid cylindrical shape and includes a plurality of clear ignition channels which are symmetrically disposed about said longitudinal axis of said ignition transfer charge, said ignition transfer charge being connected to an interior wall of said supporting tube

6. An ignition transfer body as defined in claim 1, wherein said supporting tube and said ignition transfer charge are connected together by an adhesive attaching means.

7. An ignition transfer body as defined in claim 1, wherein said supporting tube and said ignition transfer charge comprise a single jointly extruded tube.

8. An ignition transfer body as defined in claim 1, wherein said ignition transfer charge comprises a coating sprayed onto an interior wall of said supporting tube.

9. An ignition transfer body as defined in claim 1, wherein said ignition transfer charge comprises a thin sheet formed into a tube-shaped body which is fixed to an interior wall of said supporting tube by an attaching means.

10. An ignition transfer body as defined in claim 1, wherein said ignition transfer charge has a hollow tubular shape; and said ignition transfer charge and said supporting tube have a combined tube wall thickness in a range between 1 mm and 10 mm.

11. An ignition transfer body as defined in claim 1, wherein said clear ignition channel is delimited by an interior surface of said ignition transfer charge, said interior surface having a plurality of longitudinally disposed grooves therein.

12. An ignition transfer body as defined in claim 1, wherein said clear ignition channel is bounded by an interior surface of said ignition transfer charge, said interior surface having a plurality of transverse grooves therein which are disposed generally concentrically about said longitudinal axis.

13. A propellant-charge module of the type including an envelope having a longitudinal axis and containing a propellant-charge powder, and a tubular ignition body supported within the envelope disposed coaxially about the longitudinal axis and having a longitudinally oriented clear ignition passage, the improvement comprising:

said ignition transfer body having an ignition transfer charge delimiting said clear ignition passage, said ignition transfer charge being composed of a high energy first propellant-charge powder generating thermal energy in a range from 3 kJ/g to 4.5 kJ/g; and a coaxial supporting tube encasing said ignition transfer charge, said supporting tube being composed of a second propellant-charge powder.

14. A propellant-charge module as defined in claim 13, wherein said second propellant-charge powder composing said supporting tube is in the form of pressed powder.

15. A propellant-charge module as defined in claim 13, wherein said high energy first propellant-charge powder is composed of a mixture of nitrocellulose containing 20% to 50% nitroglycerin.

16. A propellant-charge module as defined in claim 13, wherein said ignition transfer charge comprises a preshaped tube which is fastened to an inner wall of said supporting tube.

17. A propellant-charge module as defined in claim 13, wherein said ignition transfer charge is a solid cylindrical body having a plurality of clear ignition channels which are disposed generally parallel to said axis, said ignition transfer charge being fastened to an interior wall of said supporting tube.

18. A propellant-charge module as defined in claim 13, wherein said supporting tube and said ignition transfer charge comprise a single jointly extruded tube.

19. A propellant-charge module as defined in claim 13, wherein said ignition transfer charge comprises a coating substantially entirely covering an interior wall of said supporting tube.

20. A propellant-charge module as defined in claim 13, wherein said ignition transfer charge comprises a thin sheet formed into a tube-shaped body which is fastened to an interior wall of said supporting tube by an attaching means.

* * * * *